US005848790A

United States Patent [19]

Huynh

[11] Patent Number: 5,848,790

[45] Date of Patent: Dec. 15, 1998

[54] METHOD OF PLAYING A WAGERING GAME

[76] Inventor: Hai Q. Huynh, 663 High Glen Dr., San Jose, Calif. 95133

[21] Appl. No.: 944,327

[22] Filed: Oct. 6, 1997

[51] Int. Cl.[6] ..... A63F 1/00

[52] U.S. Cl. ..... 273/292

[58] Field of Search ..... 273/292, 274, 273/309, 303

[56] References Cited

U.S. PATENT DOCUMENTS

| | | | |
|---|---|---|---|
| 5,249,809 | 10/1993 | Wolf | 273/292 X |
| 5,452,900 | 9/1995 | Skratulia | 273/292 |
| 5,690,335 | 11/1997 | Skratulia | 273/292 |
| 5,713,573 | 2/1998 | Nazaryan | 273/292 |
| 5,722,661 | 3/1998 | Skratulia et al. | 273/292 |
| 5,725,215 | 3/1998 | Hesse | 273/292 |

*Primary Examiner*—William E. Stoll
*Attorney, Agent, or Firm*—Timothy T. Tyson; Ted Masters; Freilich, Hornbaker & Rosen

[57] ABSTRACT

A method of playing a wagering game 20 between a plurality of players includes first determining if the hand is to be played even or odd, and then dealing two-card hands from a standard 52 card deck to each player, including a player-banker. The cards have numerical values, ace equals one, face cards equal zero, and two through ten equal their respective face values. The players are afforded the opportunity to (a) draw one additional card, or (b) stand with the dealt cards. The object of the game 20 is to have the highest least significant digit of the total of the cards, either two or three cards as may be the case, and to have the least significant digit (LSD) be even if the hand is played even or have LSD be odd if the hand is played odd. If the least significant digit of the total of the cards of neither player is even if even was selected, or is odd if odd was selected, the hand is a push (tie) and no wager 500 is won by either player.

8 Claims, 6 Drawing Sheets

METHOD OF PLAYING A WAGERING GAME

TECHNICAL FIELD

The present invention pertains generally to games and more particularly to wagering games.

BACKGROUND ART

The present invention constitutes a novel wagering game, entitled "Even or Odd". While no closely related prior art game has been identified, an even-odd type game employing four coins was originated in Asian countries. In this game the four coins are shook in a cup and the resulting hand is defined as even if all four coins are heads, all four coins are tails, or two coins are heads and two coins are tails. Similarly, the hand is defined as odd if three coins are heads and one coin is tails, or visa versa. Also, the present invention has certain superficial similarities to the games of Super Pan-9, California Baccarat, and Pai-Gow Poker, however the objective and playing methodology of the present invention depart significantly from these existing games.

DISCLOSURE OF INVENTION

The present invention is directed to a wagering game which is played by a plurality of players.

In accordance with a preferred embodiment of the invention, the wagering game is played with a deck of cards having established numerical values for each card, the values being, ace equals one, face cards equal zero, and cards two through ten equal their face value.

In accordance with another preferred embodiment of the invention, the game includes a player-banker and a randomly selected action player. It is then determined whether the hand is to be played as an even hand or as an odd hand. The players each place a wager and are dealt two-card hands. The players are then given the opportunity to either (a) draw one additional card, or (b) stand with the dealt cards.

In accordance with another preferred embodiment of the invention, commencing with the action player the players sequentially expose and compare hands with the player-banker, and the player with the better hand wins the wager of the player who is not the player-banker. To determine which player wins the wager, the cards of each player's are numerically summed and the least significant digit of the total is observed. The winning player has the highest least significant digit which is even for even played hands or odd for odd played hands.

In accordance with an important feature of the invention, if the least significant digit of the cards of neither player total to even if even was selected, or total to odd if odd was selected, the hand is a push (tie) and no wager 500 is won by either player.

In accordance with an important aspect of the invention, the deck of cards is a standard 52-card deck.

In accordance with another important feature of the invention, eight players participate.

In accordance with another important aspect of the invention, the wagers may range between a maximum wager and a minimum wager.

In accordance with another preferred embodiment, the wager of the player-banker forms an initial bank which is reduced by the amount of the wager each time a wager is won to form a remaining bank. Prior to any exposure and comparison of hands, the remaining bank must greater than zero, else the hand (wagering round) is ended even though all players may not have participated.

Other features and advantages of the present invention will become apparent from the following detailed description, taken in conjunction with the accompanying drawings, which illustrate, by way of example, the principles of the invention.

MODES FOR CARRYING OUT THE INVENTION

Figure 1A:
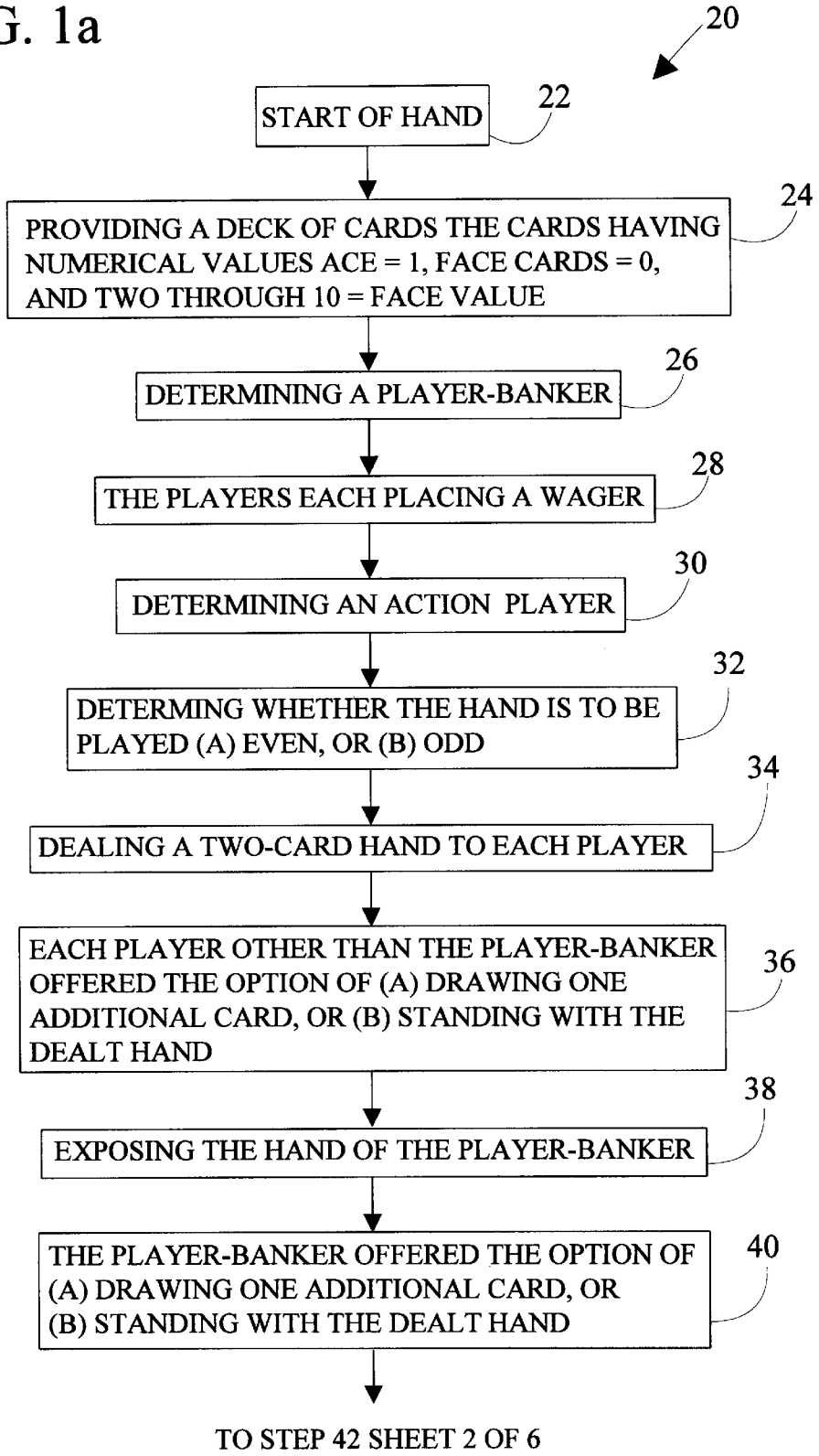
FIG. 1*a* is the start of a flow diagram illustrating the steps and method of play of a game in accordance with the present invention.
Figure 1B:
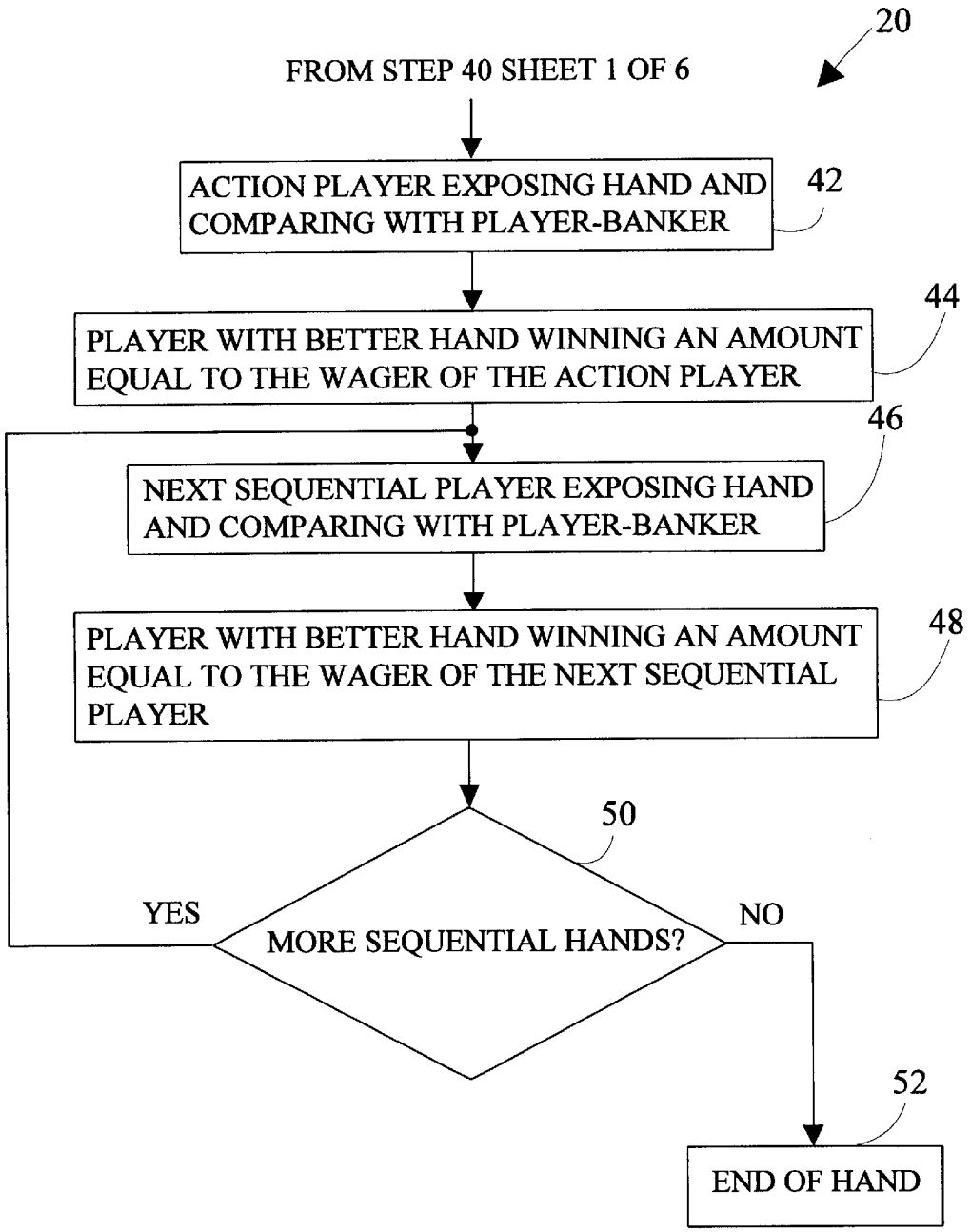
FIG. 1*b* is a continuation of FIG. 1*a;*
Figure 2:
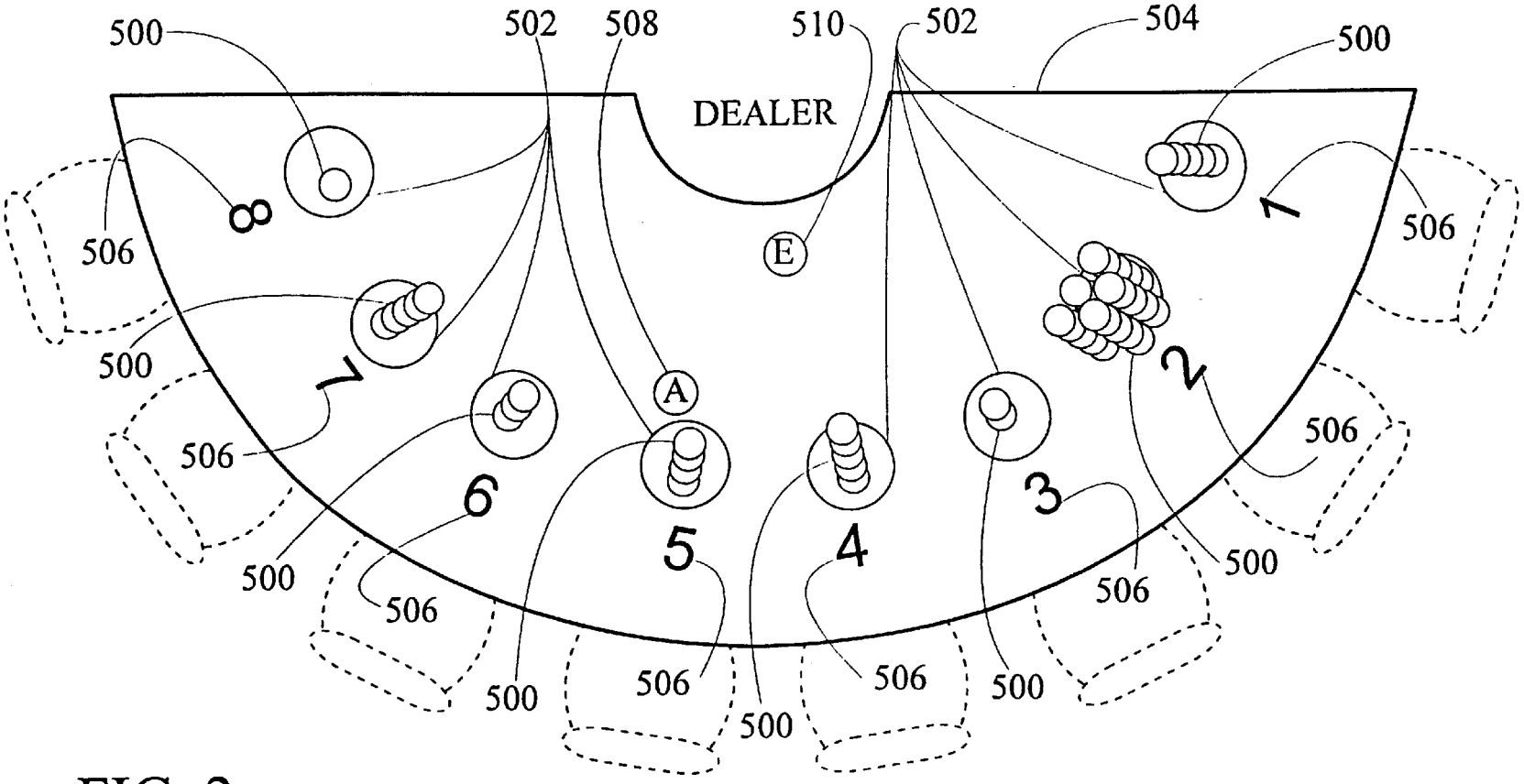
FIG. 2 is a plan view of a playing table layout.

Referring initially to FIG. 1, comprising FIGS. 1*a* and 1*b*, and FIG. 2, there are depicted a flow diagram illustrating the steps and method of play and the table layout, respectively, of a wagering game wherein wagers are apportioned between a plurality of game players utilizing a deck of cards in accordance with the present invention, generally designated as 20. The wagering game includes a plurality of players, eight being preferred, and a non-playing/non-wagering dealer who represents a disenfranchised casino or other gaming establishment.

Referring to FIG. 1, a hand begins with start terminator step 22. In step 24 a deck of cards is provided. In a preferred embodiment, a standard 52 card deck is used, and if the wagering game 20 is dealt from a shoe, any number of decks may be used with five decks being preferred, for a total of 260 cards. Also in step 24 the cards are assigned numerical values, ace equal to one, face cards equal to zero, and cards two through ten equal to their respective face values. In step 26 a player-banker, also known as a banker, who plays against the other players, is determined. Each player is afforded the opportunity to be the player-banker. After being player-banker for a maximum of two hands (wagering rounds), the opportunity passes to the next player, who may choose to be player-banker or refuse. In step 28 the players including the player-banker each place a wager 500 (refer to FIG. 2). In a preferred embodiment, a collection fee is also contributed by each player to the gaming establishment to pay for the cost of conducting the game 20. The players place their wagers 500 in betting areas 502 directly in front of them on playing table 504. The playing table 504 includes playing positions 506 for a plurality of players, eight in the embodiment shown in FIG. 2. Indicia depicting the betting areas 502, playing positions 506, or other pertinent information can be disposed upon the surface of the playing table 504 or a covering thereof. Depending upon gaming establishment rules, wagers 500 may be of different types. In one embodiment the wager 500 may be for any amount between a maximum and a minimum. In another embodiment, wager 500 may be a spread-limit wager 500 which may be for a maximum amount, a minimum amount, or one of a plurality of predetermined incremental values between the two. For example, $10 (minimum), or $15, or $20, or $25, or $30 (maximum).

The wager 500 of the player-banker differs in concept from those of the other players. In that all players play against the player-banker, the player-banker's wager 500 forms an initial bank and will normally be much greater than the wagers 500 of the other players, and in fact will usually, but not mandatorily, equal the sum of the wagers 500 of all the other players. This is called "covering the table". In the example shown in FIG. 2, the player-banker occupies playing position 2 and has wagered an amount of 25 chips forming a bank which exactly equals the sum of the wagers 500 of the all other players.

In step 30 an action player (position) is randomly selected and an action button 508 is placed in front of the selected player, player 5 in the example shown in FIG. 2. The action player is sometimes also known as the action position or first action player, and is usually the first player to receive cards and expose and compare hands with the player-banker. In a preferred embodiment, the action player selection is accomplished by having the player-banker roll three dice, and then counting out the total of the dice sequentially around the table to determine the action player. It is noted that other action player-determining procedures could also be employed, such as a spinning devices or drawn tokens. Also, the position of the action player could simple rotate around the table for each hand.

In step 32, it is determined whether the hand is to be played (a) even, or (b) odd. In a preferred embodiment, this determination is made by the player-banker, and an even/odd button 510, having a representation of even on one side and a representation of odd on the other side, is placed on playing table 504 (refer to FIG. 2). It is noted that, all players must play the hand even or odd in accordance with the determination of the player-banker. In step 34, the dealer sequentially deals two-card hands to each player. In step 36, each player other than the player-banker, is sequentially offered the option of (a) drawing one additional card, or (b) standing with the dealt four-card hand. In preferred embodiments, the action player is the first to be dealt cards and offered the drawing option. The direction of sequential action may either be clockwise which is preferred, or counterclockwise. In a preferred embodiment, to denote their desire, the players will place their cards in a "hit" or "stand" box disposed directly in front of them on playing table 504. In step 38 the two-card hand of the player-banker is exposed (opened). In step 40 the player-banker is offered the option of (a) drawing one additional card, or (b) standing with the dealt four-card hand. In step 42 the action player exposes and compares hands with the player-banker. In step 44 the player having the better hand (winner) wins an amount equal to the wager 500 of the action player from the other player (loser). The better hand is determined as follows: The objective of the game is to have the highest least significant digit (LSD) of the total of the cards, either two or three cards as may be the case, and to have the LSD be even if even was selected in the previous step of determining whether the hand is to be played (a) even, or (b) odd, or to have the LSD be odd if odd was selected in the previous step of determining whether the hand is to be played (a) even, or (b) odd. In other words, the competing player who has the highest LSD of the total of all cards in his/her hand, and whose LSD matches the selected even or odd, wins the wager 500. For example, if the hand is played odd (as determined by the player-banker), and the hand of player 1 included the cards queen and six (0+6=6 for a value of even six), and the hand of player 2, the competing player-banker, included the cards ace and two (1+2=3 for a value of odd three), then since player 2 is the only odd player, player 2 would win the wager 500 of player 1. Similarly, for even play, if player 1 had four, seven, and three (4+7+3=4 for a value of even four), and player 2 had eight and eight (8+8=16 for a value of even six), player 2 would again win the wager 500 of player 1.

For even-played hands, the ranking of the hands from highest value (best) to lowest value (worst) is:

Even Hands
even eight
even six
even four
even two
even zero
not even (odd)

For odd-played hands, the ranking of the hands from highest value (best) to lowest value (worst) is:

Odd Hands
odd nine
odd seven
odd five
odd three
odd one
not odd (even)

In step 44 (and also in step 48 below), if the LSD of the cards of neither player total to even if even was selected, or total to odd if odd was selected, the hand is a push (tie) and no wager 500 is won by either player. Similarly, if both players have identically valued hands that are correctly even or odd, the hand is a push and no wager 500 is won by either player.

In step 46 the next sequential player exposes and compares hands with the player-banker. In step 48 the player having the better hand, as defined in step 44 above, wins an amount equal to the wager 500 of the next sequential player. In step 50 if there are more sequential players (yes), steps 46, 48, and 50 are repeated until all players have participated. In step 50, if there are no more sequential players (no), the game 20 proceeds to end terminator step 52 and the hand (wagering round) is ended.

Figure 3:
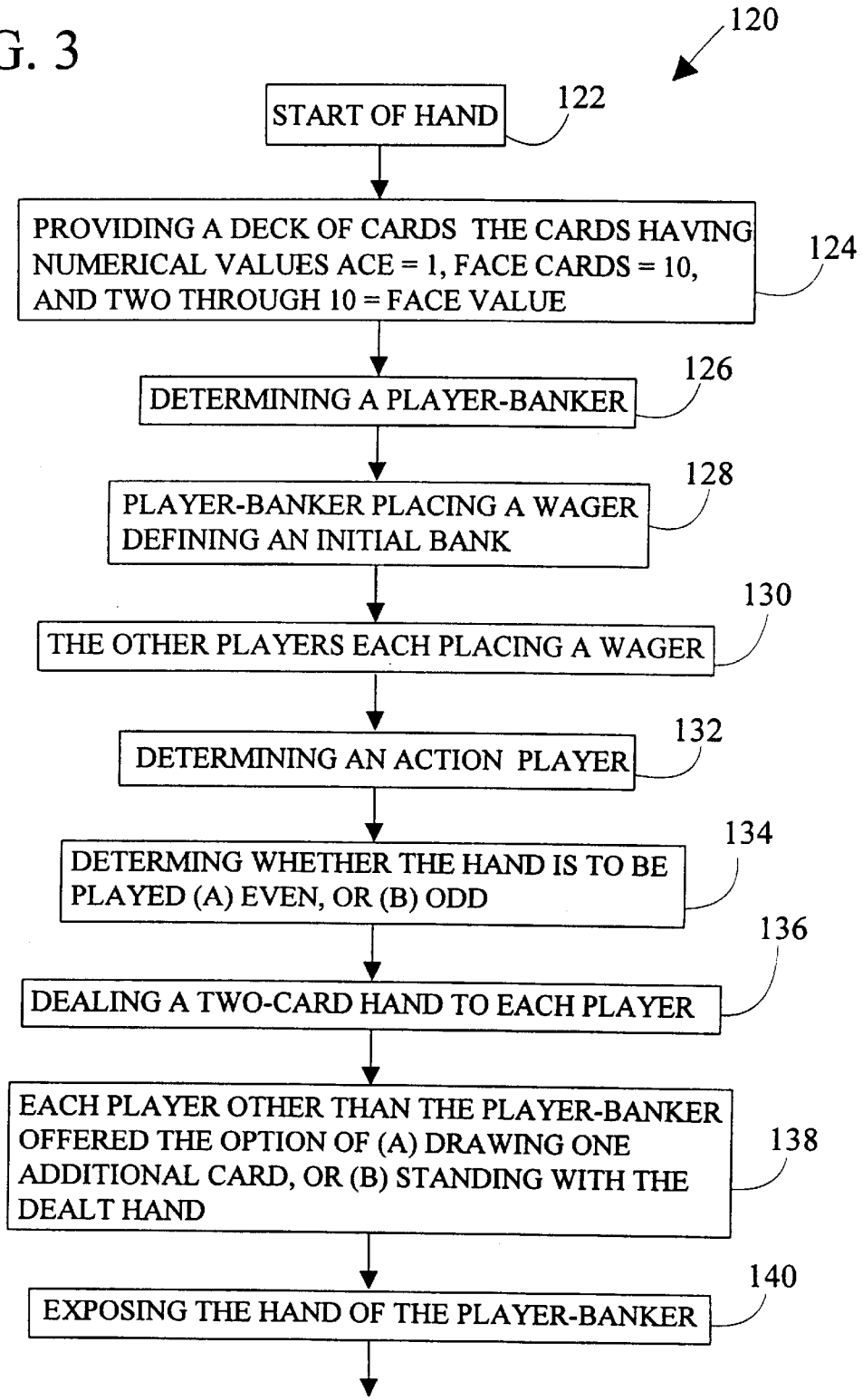
FIG. 3*a* is the start of a flow diagram illustrating the steps and method of play of a second embodiment.
FIG. 3*b* is a continuation of FIG. 3*a*.
FIG. 3*c* is a continuation of FIGS. 3*a* and 3*b*.
Figure 3B:
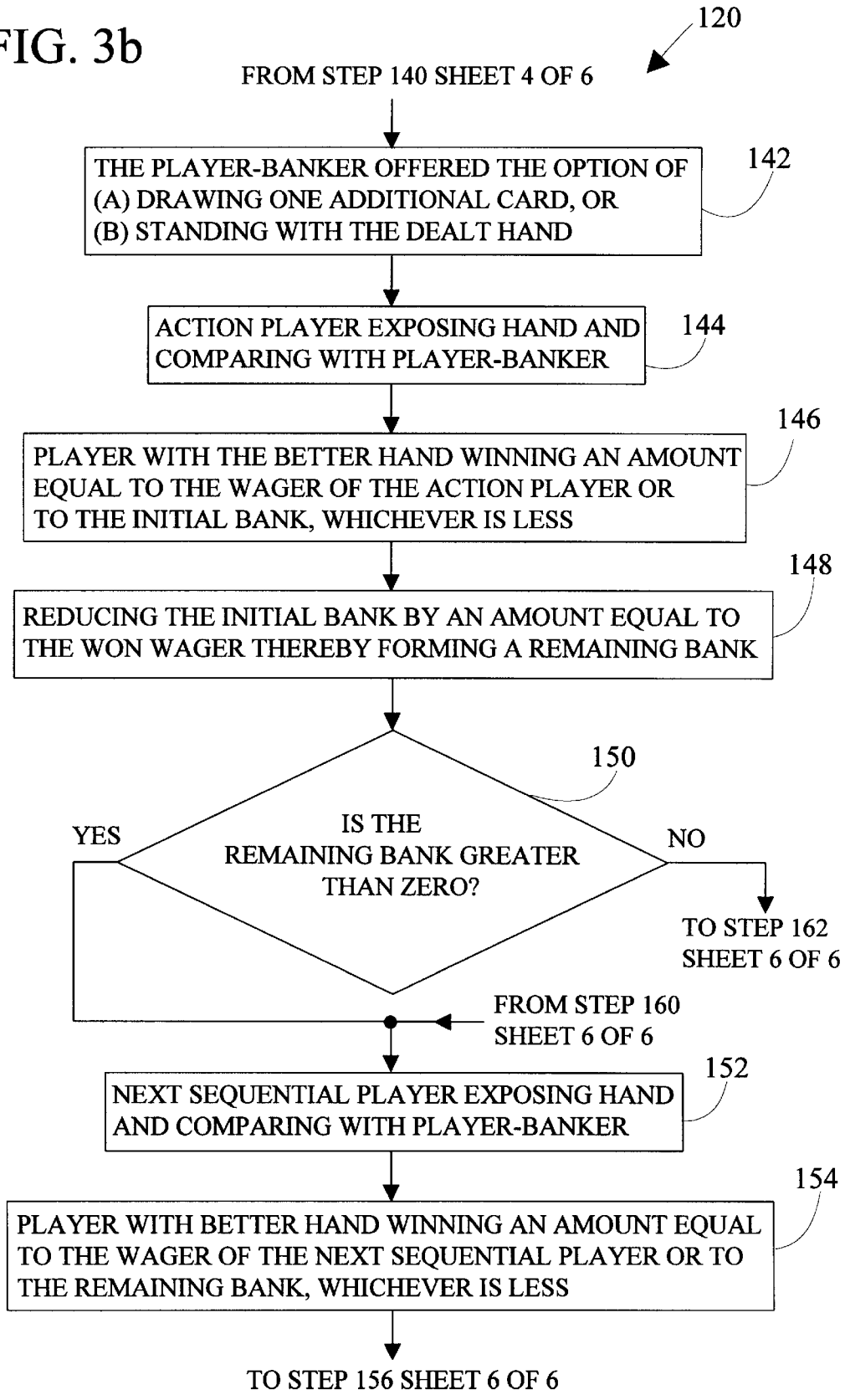
Figure 3C:
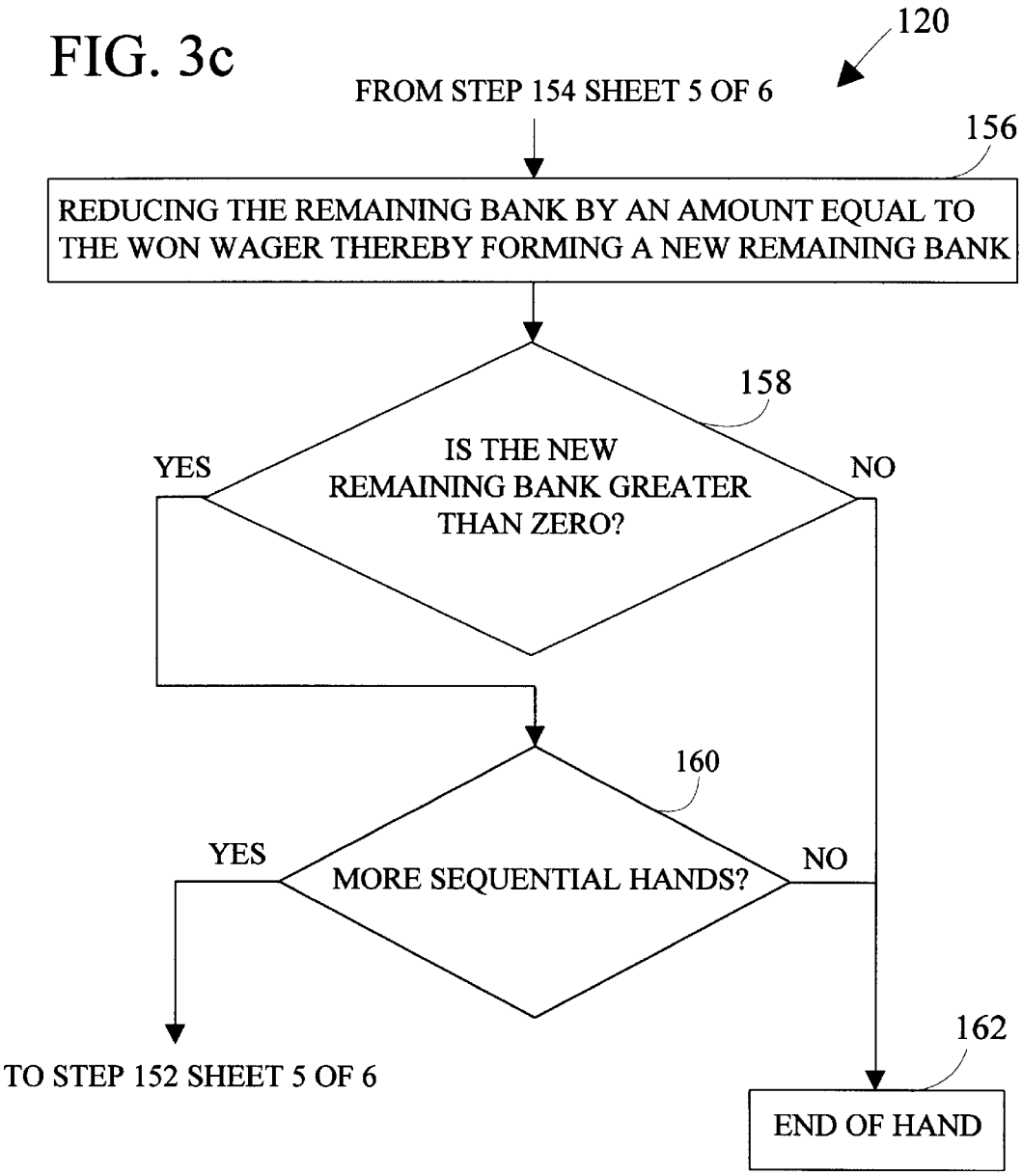

FIG. 3, comprising FIGS. 3*a*, 3*b*, and 3*c* is a flow diagram illustrating the steps and method of play of a second embodiment, generally designated as 120. Wagering game 120 is very similar to previously disclosed wagering game 20, but includes the additional feature of reducing the value of the bank of the playerbanker each time a wager 500 is won to form a remaining bank or "amount at risk". Each time a wager 500 is won in steps 146 and 154, the bank of the player-banker is reduced by an amount equal to the won wager 500. Prior to exposing and comparing hands with the next sequential player, the value of the remaining bank must be greater than zero, else the hand (wagering round) is immediately ended even though all players may not have participated.

Referring to FIG. 3, a hand begins with start terminator step 122. In step 124 a deck of cards is provided. In a preferred embodiment, a standard 52 card deck is used, and if the wagering game 120 is dealt from a shoe, any number of decks may be used with five decks being preferred, for a total of 260 cards. Also in step 124 the cards are assigned numerical values, ace equal to one, face cards equal to zero, and cards two through ten equal to their respective face values. In step 126 a player-banker, who plays against the other players, is determined. Each player is afforded the opportunity to be the player-banker. After being player-banker for a maximum of two hands (wagering rounds), the opportunity passes to the next player, who may choose to be player-banker or refuse. In step 128 the player-banker places a wager 500 defining an initial bank. The wager 500 of the player-banker differs in concept from those of the other players. In that all players play against the player-banker, the player-banker's wager 500 forms an initial bank and will normally be much greater than the wagers 500 of the other players, and in fact will usually, but not mandatorily, equal the sum of the wagers 500 of all the other players. This is called "covering the table". In the example shown in FIG. 2, the player-banker occupies playing position 2 and has wagered an amount of 25 chips forming a bank which exactly equals the sum of the wagers 500 of the all other players.

In step 130 the players other than the player-banker each place a wager 500 (refer to FIG. 2). In a preferred embodiment, a collection fee is also contributed by each player to the gaming establishment to pay for the cost of conducting the game 120. The players place their wagers 500 in betting areas 502 directly in front of them on playing table 504. The playing table 504 includes playing positions 506 for a plurality of players, eight in the embodiment shown in FIG. 2. Indicia depicting the betting areas 502, playing positions 506, or other pertinent information can be disposed upon the surface of the playing table 504 or a covering thereof. Depending upon gaming establishment rules, wagers 500 may be of different types. In one embodiment the wager 500 may be for any amount between a maximum and a minimum. In another embodiment, wager 500 may be a spread-limit wager 500 which may be for a maximum amount, a minimum amount, or one of a plurality of predetermined incremental values between the two. For example, $10 (minimum), or $15, or $20, or $25, or $30 (maximum). It is noted that steps 128 and 130 may be reversed wherein the other players place their wagers 500 before the player-banker places a wager 500, or steps 128 and 130 may be performed simultaneously.

In step 132 an action player (position) is randomly 35 selected and an action button 508 is placed in front of the selected player, player 5 in the example shown in FIG. 2. In a preferred embodiment, the action player selection is accomplished by having the player-banker roll three dice, and then counting out the total of the dice sequentially around the table to determine the action player. It is noted that other action player-determining procedures could also be employed, such as a spinning devices or drawn tokens. Also, the position of the action player could simple rotate around the table for each hand.

In step 134, it is determined whether the hand is to be played (a) even, or (b) odd. In a preferred embodiment, this determination is made by the player-banker, and an even/odd button 510, having a representation of even on one side and a representation of odd on the other side, is placed on playing table 504 (refer to FIG. 2). It is noted that, all players must play the hand even or odd in accordance with the determination of the player-banker.

In step 136, the dealer sequentially deals two-card hands to each player. In step 138, each player other than the player banker, is sequentially offered the option of (a) drawing one additional card, or (b) standing with the dealt four-card hand. In preferred embodiments, the action player is the first to be dealt cards and offered the drawing option. The direction of sequential action may either be clockwise which is preferred, or counterclockwise. In step 140 the two-card hand of the player-banker is exposed (opened). In step 142 the player-banker is offered the option of (a) drawing one additional card, or (b) standing with the dealt four-card hand. In step 144 the action player exposes and compares hands with the player-banker. In step 146 the player having the better hand (winner) wins the lesser of an amount equal to the wager 500 of the action player or to the initial bank, from the other player (loser). The better hand is determined as follows: The objective of the game is to have the highest least significant digit (LSD) of the total of the cards, either two or three cards as may be the case, and to have the LSD be even if even was selected in the previous step of determining whether the hand is to be played (a) even, or (b) odd, or to have the LSD be odd if odd was selected in the previous step of determining whether the hand is to be played (a) even, or (b) odd. In other words, the competing player who has the highest LSD of the total of all cards in his/her hand, and whose LSD matches the selected even or odd, wins the wager 500. For example, if the hand is played odd (as determined by the player-banker), and the hand of player 1 included the cards queen and six (0+6=6 for a value of even six), and the hand of player 2, the competing player-banker, included the cards ace and two (1+2=3 for a value of odd three), then since player 2 is the only odd player, player 2 would win the wager 500 of player 1. Similarly, for even play, if player 1 had four, seven, and three (4+7+3=14 for a value of even four), and player 2 had eight and eight (8+8=16 for a value of even six), player 2 would again win the wager 500 of player 1.

For even-played hands, the ranking of the hands from highest value (best) to lowest value (worst) is:

Even Hands
even eight
even six
even four
even two
even zero
not even (odd)

For odd-played hands, the ranking of the hands from highest value (best) to lowest value (worst) is:

odd Hands
odd nine
odd seven
odd five
odd three
odd one
not odd (even)

In step 146 (and also in step 154 below), if the LSD of the cards of neither player total to even if even was selected, or total to odd if odd was selected, the hand is a push (tie) and no wager 500 is won by either player. Similarly, if both players have identically valued hands that are correctly even or odd, the hand is a push and no wager 500 is won by either player.

In step 148 the initial bank of the player-banker is reduced by an amount equal to the won wager 500 thereby forming a remaining bank. In step 150 it is determined if the remaining bank is greater than zero. If the remaining bank is greater than zero, then play continues. If the remaining bank is zero, then the hand (wagering round) is immediately ended in step 162. Also in step 146, if neither player wins the wager 500, and the bank is not reduced in step 148.

In step 152 the next sequential player exposes and compares hands with the player-banker. In step 154 the player having the better hand, as defined in step 146 above, wins the lesser of an amount equal to the wager 500 of the next sequential player or the remaining bank. In step 156 the remaining bank of the player-banker is reduced by an amount equal to the won wager 500. In step 158 it is determined if the remaining bank is greater than zero. If the remaining bank is greater than zero, then play continues. If the remaining bank is zero, then the hand (wagering round)

is immediately ended in step 162. Also in step 146, if neither player wins the wager 500, and the bank is not reduced in step 156.

In step 160 if there are more sequential players (yes), steps 152 through 160 are repeated until all players have participated. In step 160, if there are no more sequential players (no), the game 120 proceeds to end terminator step 162 and the hand (wagering round) is ended.

The preferred embodiments of the invention described herein are exemplary and numerous modifications, procedural variations, rearrangements, and adjustments can be readily envisioned to achieve an equivalent result, all of which are intended to be embraced within the scope of the appended claims.

I claim:

1. A method of apportioning wagers between a plurality of game players, comprising the steps of:

providing a deck of cards each card having a numerical value, said values being, ace equals one, face cards equal zero, and cards two through ten equal their face value;

determining a player-banker;

the players each placing a wager;

determining an action player;

determining whether the hand is to be played (a) even, or (b) odd;

a dealer dealing a two-card hand to each player;

offering each player other than the player-banker the option of selecting one of (a) drawing one additional card, or (b) standing with the dealt cards;

exposing the hand of the player-banker;

offering the player-banker the option of selecting one of (a) drawing one additional card, or (b) standing with the dealt cards;

the action player exposing and comparing hands with the player-banker;

the player having the better hand winning an amount equal to said wager of the action player from the other player, the better hand being the hand wherein (1) the total of the cards has the highest odd least significant digit if the hand is played odd, or (2) the total of the cards has the highest even least significant digit if the hand is played even;

the next sequential player exposing and comparing hands with the player-banker;

the player having the better hand winning an amount equal to said wager of the next sequential player from the other player; and, repeating said steps of the next sequential player exposing and comparing hands with the player-banker, and the player with the better hand winning an amount equal to said wager of the next sequential player, until all players have participated.

2. The method according to claim 1, wherein said deck of cards includes a standard 52 card deck.

3. The method according to claim 1, wherein in the steps of the player having the better hand winning an amount equal to said wager of the action player and the player having the better hand winning an amount equal to said wager of the next sequential player, if the least significant digit of the cards of neither player total to even if even was selected, or total to odd if odd was selected, the hand is a push and no said wager in won by either player.

4. The method according to claim 1, wherein said plurality of game players includes eight players.

5. The method according to claim 1, wherein said step of the players each placing a wager includes each player contributing a collection fee.

6. The method according to claim 1, wherein said wager includes a spread-limit wager having a maximum wager, a minimum wager, and a plurality of predetermined incremental wagers therebetween.

7. The method according to claim 1, wherein said wager may range between a maximum wager and a minimum wager.

8. A method of apportioning wagers between a plurality of game players, comprising the steps of:

providing a deck of cards each card having a numerical value, said values being, ace equals one, face cards equal zero, and cards two through ten equal their face value;

determining a player-banker;

the player-banker placing a wager defining an initial bank;

the players other than the player-banker each placing a wager;

determining an action player;

determining whether the hand is to be played (a) even, or (b) odd;

a dealer dealing a two-card hand to each player;

offering each player other than the player-banker the option of selecting one of (a) drawing one additional card, or (b) standing with the dealt cards;

exposing the hand of the player-banker;

offering the player-banker the option of selecting one of (a) drawing one additional card, or (b) standing with the dealt cards;

the action player exposing and comparing hands with the player-banker;

the player having the better hand winning an amount equal to the lesser of said wager of the action player or said initial bank from the other player, the better hand being the hand wherein (1) the total of the cards has the highest odd least significant digit if the hand is played odd, or (2) the total of the cards has the highest even least significant digit if the hand is played even;

reducing said initial bank by the amount of said won wager thereby forming a remaining bank;

ensuring that said remaining bank is equal to or greater than zero, else ending the hand;

the next sequential player exposing and comparing hands with the player-banker;

the player having the better hand winning an amount equal to the lesser of said wager of the next sequential player or said remaining bank from the other player;

reducing said remaining bank by the amount of said won wager thereby forming as new remaining bank;

ensuring that said new remaining bank is greater than zero, else ending the hand; and, repeating said steps of the next sequential player exposing and comparing hands with the player-banker, and the player with the better hand winning an amount equal to the lesser of said wager of the next sequential player or said new remaining bank, and reducing said new remaining bank by the amount of said won wager, and ensuring that said new remaining bank is greater than zero else ending the hand, until all players have participated.

* * * * *